US005562478A

United States Patent [19]

Yamamoto

[11] Patent Number: 5,562,478

[45] Date of Patent: Oct. 8, 1996

[54] JOINT CONNECTOR AND A METHOD OF ASSEMBLING A JOINT CONNECTOR

[75] Inventor: Hiroshi Yamamoto, Shizuoka, Japan

[73] Assignee: Yazaki Corporation, Tokyo, Japan

[21] Appl. No.: 568,373

[22] Filed: Dec. 6, 1995

[30] Foreign Application Priority Data

Dec. 6, 1994 [JP] Japan ..... 6-302328

[51] Int. Cl.[6] ..... H01R 4/24

[52] U.S. Cl. ..... 439/402; 439/417

[58] Field of Search ..... 439/402, 398, 439/397, 409, 417, 404, 405, 596; 29/883

[56] References Cited

U.S. PATENT DOCUMENTS

| | | | |
|---|---|---|---|
| 3,835,444 | 9/1974 | Plana et al. | 439/398 |
| 4,822,299 | 4/1989 | Rider, Jr. | 439/402 |
| 4,981,443 | 1/1991 | Suverison et al. | 439/398 |
| 5,080,606 | 1/1992 | Burkard | 439/402 |
| 5,494,455 | 2/1996 | Shindoh et al. | 439/402 |

*Primary Examiner*—Neil Abrams
*Assistant Examiner*—Brian Biggi
*Attorney, Agent, or Firm*—Sughrue, Mion, Zinn, Macpeak & Seas

[57] ABSTRACT

A method of assembling a press-connecting joint connector which can be miniaturized by decreasing its longitudinal dimension with its mechanical strength maintained unchanged, and the structure of the joint connector. A press-connecting joint terminal 1 includes a connector body 2, and a cover 4 which is engaged with the connector body 2. Provided in the connector body 2 is a terminal 6 which is made up of a metal base 7 from the front and rear edges of which a plurality of press-connecting blades 8A and 8B extend. The terminal 6 is embedded in the connector body 2 in such a manner that its one end portion extends to a side surface of the connector body 2, thus serving as a metal piece 10. The cover 4 includes a locking arm 18 which is locked to the metal piece. When locked to the metal piece 10, the locking arm 18 becomes a part of the side wall 11 of the connector body 2. The locking arm 18 has a locking groove which is engaged with the metal piece 10 in such a manner that the locking arm covers the metal piece.

9 Claims, 4 Drawing Sheets

JOINT CONNECTOR AND A METHOD OF ASSEMBLING A JOINT CONNECTOR

BACKGROUND OF THE INVENTION

1. Field of the Industrial Application

This invention relates to a press-connecting joint connector used to electrically connect a plurality of covered wires, and more particularly to a method of assembling a press-connecting joint connector having a compact connector body.

2. Related art

A variety of press-connecting joint connectors have been proposed in the art which are adapted to press-connect electrical wires in the connector body. One of those conventional press-connecting joint connectors has been disclosed in Japanese Utility Patent Application (OPI) No. 77564/1986 (the term "OPI" as used herein means an "unexamined publication application").

The conventional press-connecting joint connector is generally indicated at 51 in FIG. 6. The joint connector 51 comprises: a terminal 54 made up of two metal plates each of which has right and left press-connecting blades 53 which are used to electrically connect two covered wires 52 to each other; a connector body 55 made of synthetic resin in which the terminal 54 is been embedded; and a cover 56 which covers the connector body 55 from above and presses the wires 55 against the press-connecting blades 53.

The connector 55 has two wire receiving grooves 57 which extend in parallel with each other and over the terminal 54. More specifically, each of the grooves 57 extends to the front and rear of the terminal 54. The connector body 55 has a pair of longitudinal side walls 58 on each of which front and rear temporary locking protrusions 59 are formed. In addition, on each of the longitudinal side walls 58, two final locking protrusions 60 are formed below the temporary locking protrusions 59, respectively. The final locking protrusions 60 protrude further than the temporary locking protrusions 59. Furthermore, the connector body has a front end wall 61 and a rear end wall 62 on opposite ends, as viewed in the longitudinal direction. The end walls 61 and 62 are designed to position the cover 56 in the front-to-rear direction.

Four locking arms 64 extend downwardly from the upper wall of the cover 56. Each of the locking arms 64 has a vertically elongated locking hole 65 which is alternatively engageable with the temporary locking protrusion 59 and the final locking protrusion 60. The bottom surface of each of the locking holes 65 is employed as a locking surface. In order to press the wires 52 from above, wire pressing members 67 are formed on the lower surface of the upper wall of the cover in such a manner that they extend in the longitudinal direction.

With the press-connecting joint connector, the two wires 52 are connected to each other as follows. First the wires 52 are set in the connector body 55; that is, they are placed in the wire receiving grooves 57 and on the press-connecting blades 53. Thereafter, the cover 56 is pushed downwardly, towards the connector body. As a result, the locking arms 64 are flexed sidewards, and the locking surfaces 66 become engaged with the temporary locking protrusions 59, so that the wire pressing members 67 abut against the wires 52. Thus, with the wires 52 lightly pressed against the press-connecting blades 53, the cover 56 is temporarily locked to the connector body 55.

Hence, the wires 52 are accurately positioned in the connector body 55 before the cover is finally locked to the latter 55. Under this condition, the cover 56 is forcefully pushed against the connector body 55 with a pressing tool or the like, so that insulation of the wires 52 is cut with the press-connecting blades 53, and the conductors of the wires are strongly pushed against the press-connecting blades 53. Thus, the two wires 52 are electrically connected to each other, and the locking surfaces 66 of the locking arms 64 are positively engaged with the final locking protrusions 60.

However, the above-described press-connecting joint connector is not suitable for miniaturization for the following reason. In designing a compact joint connector, it is important to understand that the width cannot be reduced substantially as it depends primarily on the diameter of the wires 52. Moreover, the length A (FIG. 6) cannot be reduced to any significant degree either. In particular, since the connector body 55 is made of synthetic resin, the amount by which the width B of the final locking protrusions 60 can be reduced is limited since the locking protrusion must have certain mechanical strength. For the same reason, there is also a limit as to the amount by which the width C of the locking holes 65 of the locking arms 64 can be reduce and correspondingly to the amount by which the width D of the locking arms 64 can be reduced.

Thus, it is difficult to decrease the length A of the press-connecting joint connector 51, and therefore it is impossible to miniaturize the conventional press-connecting joint connector.

In view of the foregoing, an object of the invention is to provide a method of assembling a press-connecting joint connector which can be miniaturized by decreasing its longitudinal dimension without reducing the mechanical strength, and the structure of the joint connector.

SUMMARY OF THE INVENTION

The foregoing object of the invention has been achieved by the provision of a method of assembling a press-connecting joint connector which comprises a connector body with a terminal which has a plurality of press-connecting blades which are electrically conducted to one another to electrically connect a plurality of covered wires; and a cover which covers the connector body, and holds the wires. According to a first aspect of the invention, a locking arm provided on the cover is locked to a metal piece which is provided in the connector body in such a manner that the metal piece extends to a side surface of the connector body, to cause the cover to hold the wires.

The foregoing object has been achieved by the provision of the method in which, according to the invention, the cover is engaged with the connector body after pressing the wires against the terminal.

The foregoing object has also been achieved by the provision of a press-connecting joint connector comprising a connector body with a terminal which has a plurality of press-connecting blades which are electrically conducted to one another to electrically connect a plurality of covered wires; and a cover which covers the connector body while holding the wires, which, according to the invention, further comprisesa metal piece which is embedded in the connector body in such a manner that one end portion of the metal piece appears in a side surface of the connector body; and a locking arm provided on the cover which is locked to the metal piece.

The foregoing object has been achieved by the provision of the press-connecting joint connector in which, according to the invention, the press-connecting blades are extended from a metal plate base, and the metal piece is at least one of both end portions of the metal plate base from which appears in a side surface of the connector body.

Moreover, the foregoing object has been achieved by the provision of the press-connecting joint connector in which, according to the invention, when the locking arm is locked to the metal piece, the locking arm becomes a part of a side wall of the connector, and the locking arm has a locking groove which is engaged with the metal piece in such a manner that the locking arm covers the latter.

In the press-connecting joint connector assembling method of the invention, the locking arm of the cover is locked to the metal piece which is provided in the connector body in such a manner that one end portion of the metal piece appears in the side surface of the connector body. That is, the locking arm is locked to the metal piece which is high in mechanical strength. Hence, the width of the metal piece, as viewed in the longitudinal direction, can be decreased, and in addition, the wires can be more positively held.

Furthermore, in the method, the cover is engaged with the connector body after pressing the wires against the terminal. Therefore, it is unnecessary to design the cover body to have mechanical strength which is high enough to press-connect the wires. This feature contributes to miniaturization of the joint connector.

With the press-connecting joint connector of the invention, first a plurality of wires are pressed against the plurality of press-connecting blades of the connector body which are electrically conductive to one another, and then the locking arm of the cover is locked to the metal piece which appears in the side surface of the connector body. Hence, the wires can be electrically connected to one another while being fixedly held.

As was described above, the cover is locked through the locking arm to the metal piece which appears in the side surface of the connector body. Additionally, the metal piece is higher in mechanical strength than a resin piece which is equal in size to the former. Hence, the width of the metal piece can be decreased, which results in a reduction in the length of the joint connector.

The metal piece is provided at one end portion of the metal base, from which the press-connecting blades extend, which appears in the side surface of the connector body; that is, one and the same means is employed to lock the cover to the connector body and to electrically connect the wires to each other. Thus, the press-connecting joint connector can be decreased not only in length but also in height.

When the locking arm is locked to the metal piece, it becomes a part of the side wall of the connector body. Hence, the thickness of the locking arm can be increased to the thickness of the side wall. The locking arm has the locking groove which, when the cover is engaged with the connector body, is engaged with the metal piece in such a manner that the locking arm covers the metal piece. Hence, the width of the locking arm, as viewed in the longitudinal direction, can be decreased, and accordingly the press-connecting joint connector can be further miniaturized.

DETAILED DESCRIPTION OF THE INVENTION

Figure 1:
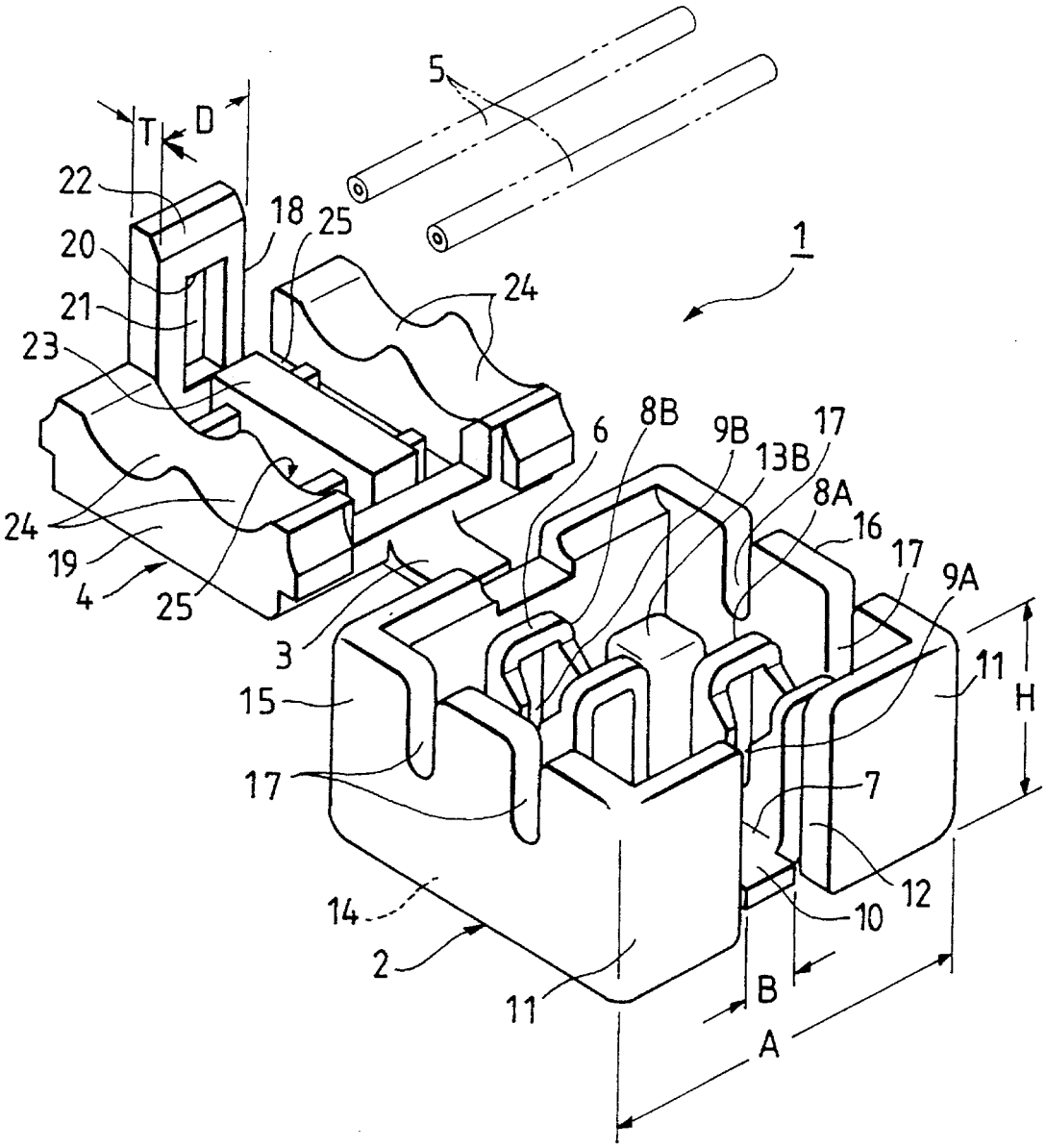
FIG. 1 is an exploded perspective view showing an example of a press-connecting joint connector according to the invention.
Figure 2:
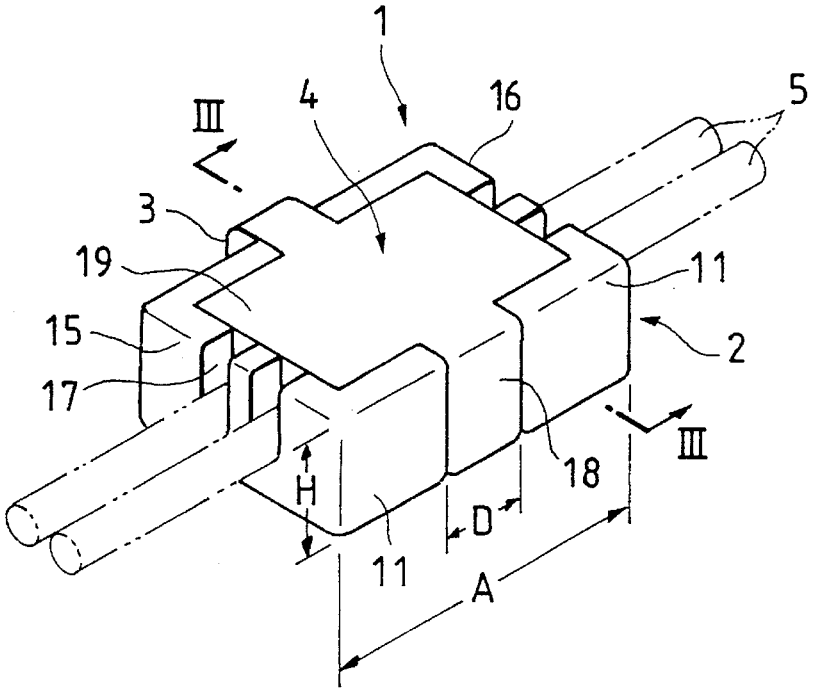
FIG. 2 is a perspective view of the joint connector which has been assembled.
Figure 3:
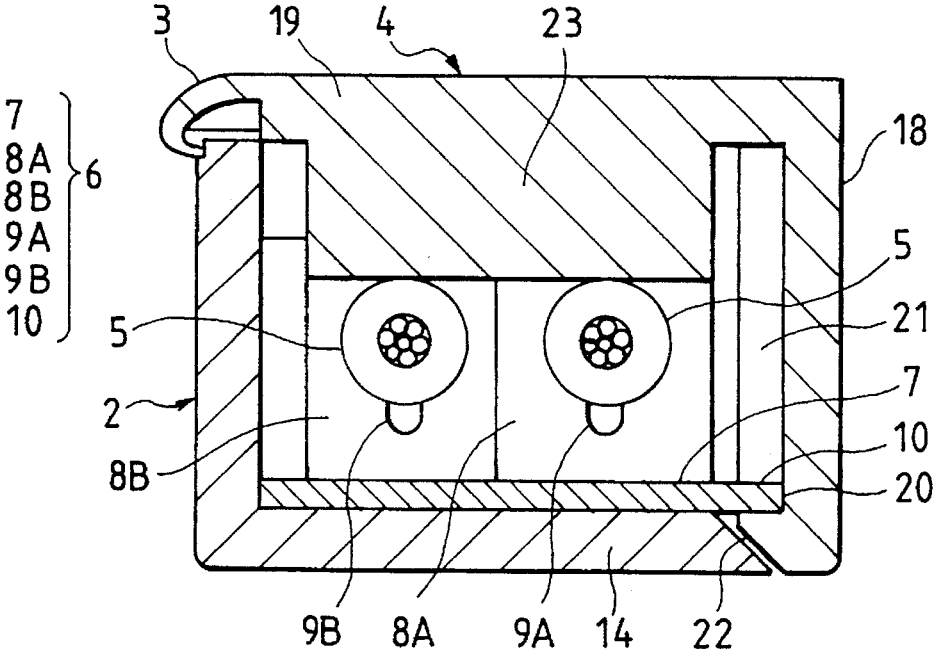
FIG. 3 is a sectional view taken along line III—III in FIG. 2.
Figure 4:
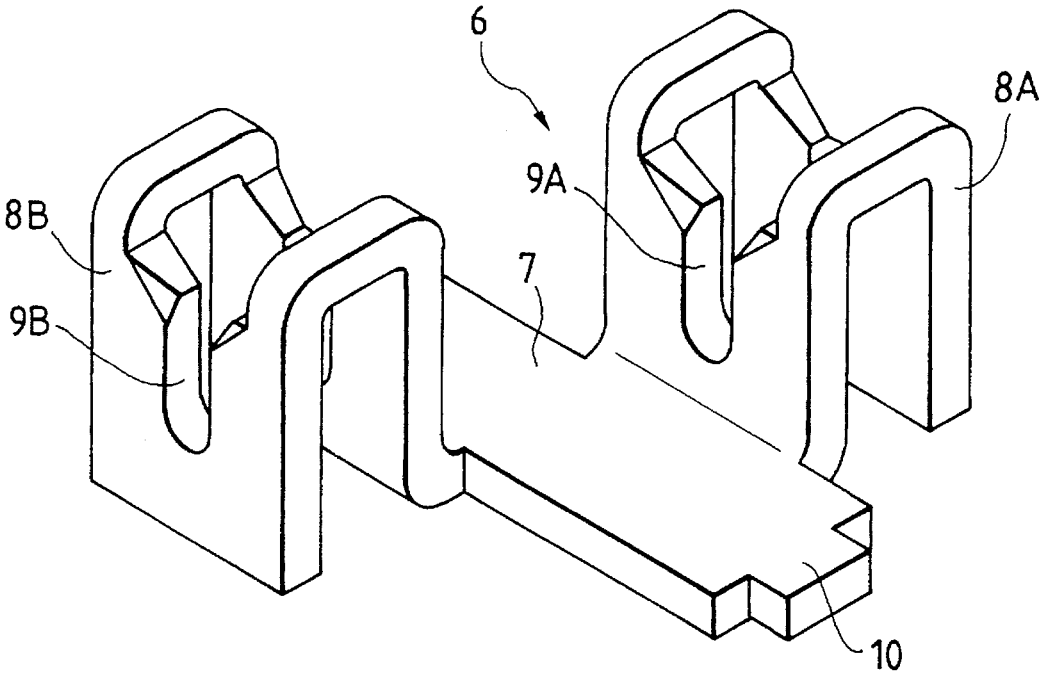
FIG. 4 is a perspective view of a terminal shown in FIG. 1.
Figure 5:
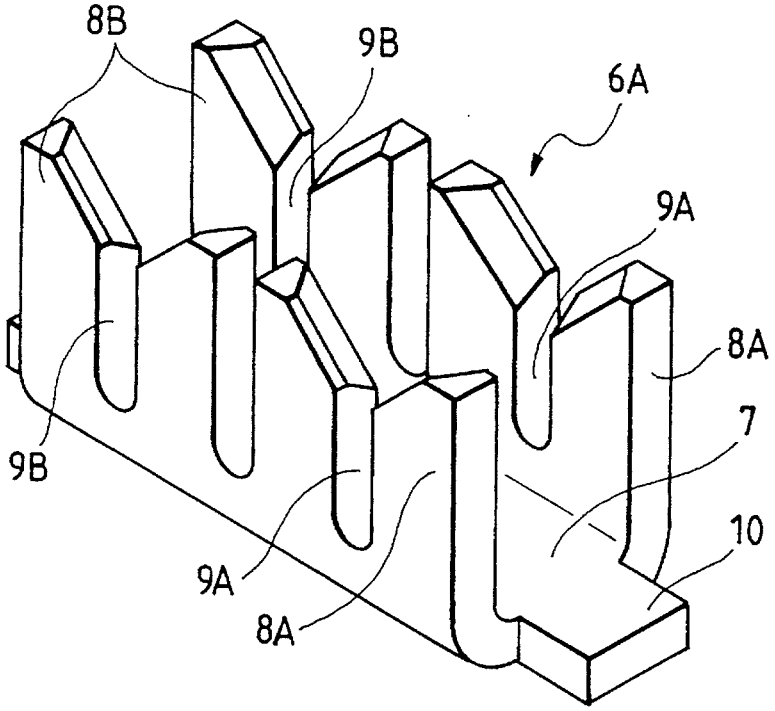
FIG. 5 is also a perspective view showing one modification of the terminal shown in FIG. 4.
Figure 6:
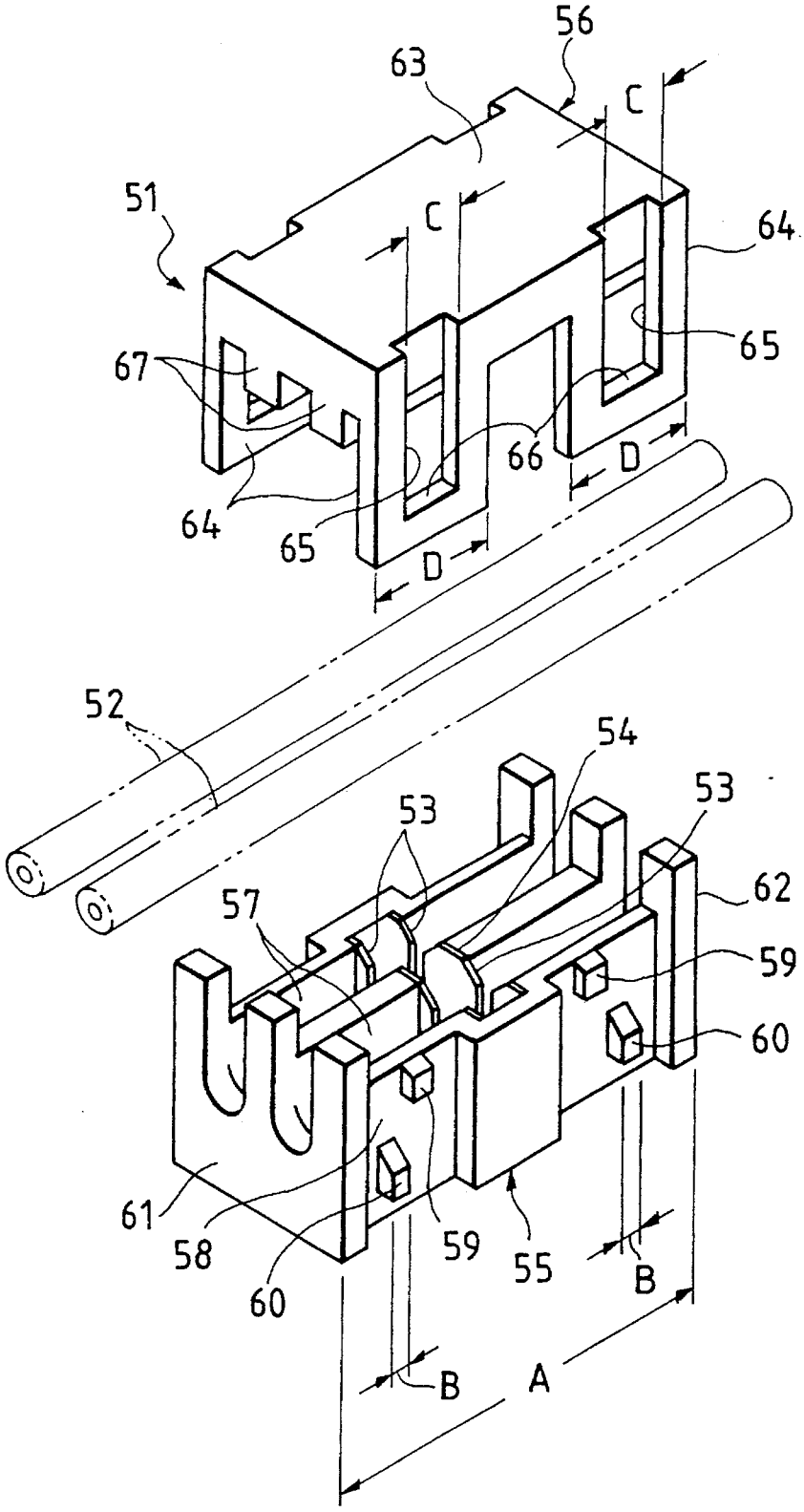
FIG. 6 is an exploded perspective view showing a conventional press-connecting joint connector.

A method of assembling a press-connecting joint connector, and the structure of the joint connector, which constitutes an embodiment of the invention, will be described with reference to FIGS. 1 through 5 in detail. FIG. 1 is an exploded perspective view showing the press-connecting joint connector according to the invention. FIG. 2 is a perspective view of the joint connector which has been assembled. FIG. 3 is a sectional view taken along line III—III in FIG. 2. FIG. 4 is a perspective view of a terminal shown in FIG. 1. Finally, FIG. 5 is also a perspective view showing one modification of the terminal shown in FIG. 4.

The press-connecting joint connector of the invention is generally indicated at 1 in FIG. 1. The joint connector 1 comprises a connector body 2, and a cover 4 which is pivotally coupled through a hinge 3 to the connector body 2. Two covered wires 5 are set in the joint connector 1 so that they are electrically connected to each other. The connector body 2, the hinge 3, and the cover 4 are made of a flexible material such as synthetic resin.

The connector body 2 has a terminal 6 (or 6A) as shown in FIG. 4 (or 5); more specifically, the terminal 6 is embedded in the connector body 2. The terminal 6 is made up of a plate-shaped metal base 7 which has front and rear press-connecting blades 8A and 8B. Those blades 8A and 8B have U-shaped slots 9A and 9B, respectively, which are used to cut the covers of the wires thereby to electrically connect the wires to each other. The metal base 7 has a metal piece 10 extending from one end. The metal piece 10 is located in the lower portion of a side wall 11 of the connector body 2 as shown in FIG. 1. The side wall 11 has a cut-out 12 into which a locking arm 18 (described below) is inserted.

A cover drop preventing member 13B is provided behind the press-connecting blade 8B. More specifically, the member 13B extends upwardly from the bottom wall 14 of the connector body 2. The connector body 2 has a second cover drop preventing member 13A which is located symmetrical to the cover drop preventing member 13A; however, it is not shown in FIG. 1 as it is hidden by the wall of the connector body. The front end wall 15 and the rear end wall 16 of the connector body 20 have a plurality of U-shaped guide grooves 17 for respectively receiving a plurality of electrical wires 5.

The cover 4 has a locking arm 18 which is engaged with the metal piece 10 located in the lower portion of the side wall of the connector body 1. More specifically, the locking arm 18 extends downwardly (upwardly in FIG. 1) from the side end face of the cover 4 which corresponds to the side wall 11 of the connector body 2. A locking groove 21 having a locking surface 20 which is formed in the inner surface of the locking arm 18, so that, when the locking surface 20 is engaged with the metal piece 10, the locking arm 18 is locked to the metal piece. The lower end portion of the locking arm 18 has a sloped guide surface 22 for facilitating smooth engagement.

On the lower surface of the upper wall 19 of the cover 4, a wire retaining member 23 is formed in such a manner that, when the cover is engaged with the connector body, it is disposed above the metal base 7. Additionally, wire retaining grooves 24 are also provided in such a manner that, when the cover is engaged with the connector body, they are located on opposite sides of the press-connecting blades 8A and 8B. In addition, relief grooves 25 and 25 are provided on opposite sides of the wire retaining member 23 so that the latter 23 may not interfere with the press-connecting blades 8A and 8B.

With the joint connector thus constructed, electrical wires are connected to each other as follows:

First, a plurality of electrical wires 5 are set in the guide grooves 17 formed in the front and rear end walls 15 and 16 of the connector body 2 and in the press-connecting blades 8A and 8B of the terminal 6. Under this condition, a jig, for example, is used to press the wires into the slots 9A and 9B of the blades 8A and 8B. Thereafter, the cover 4 is rotated about the hinge 3, so that the cover 4 is engaged with the connector body 2 from above.

As a result, the locking arm 18 is moved down the cut-out 12, and the sloped guide surface 22 is abutted against the metal piece 10. Hence, the locking arm 18 is moved downwardly while being flexed outwardly, so that the locking surface 20 is engaged with the metal piece 10.

In this operation, as shown in FIG. 3, the metal piece 10 is covered with the locking arm 18 from outside, while the cut-out 12 is closed thereby from outside. On the other hand, as shown in FIG. 2, the connector body 2 is covered with the cover 4 in such a manner that the upper wall 9 of the cover 4 is fitted in the surrounding wall of the connector body 2 which includes the front end wall 15, the rear end wall 16, and the side wall 11, and the surface of the upper wall 9 is flush with the upper end of the surrounding wall of the connector 2.

Finally, the wires 5 are fixedly held by the wire retaining member 23 and the wire retaining grooves 24, while the cover 4 is firmly locked to the connector body 2 with the aid of the locking arm 18 and the metal piece 10. In this operation, the conductors of the wires 5 are positively brought into contact with the slots 9A and 9B, so that they are electrically connected to each other through the metal base 7.

The mechanical strength of the metal piece 10, through which the cover 4 is locked to the connector body 2 is greater than that of the synthetic resin material, which makes it possible to greatly decrease the width B in the longitudinal direction. This feature makes it possible to decrease the length A of the press-connecting joint connector 1 in the longitudinal direction; that is, the latter can be miniaturized as much.

As was described above, the press-connecting blades 8A and 8B are extended from both sides of the metal base 7, which miniaturizes the electrical conducting mechanism of the joint connector as much. In addition, one end portion of the metal base 7 is formed into the metal piece 10 which appears in the side surface of the connector body 2; that is, it unnecessary to provide the metal piece as a separate component to be embedded in the connector body 2. This feature makes it possible to decrease the height H of the connector body 2.

As is apparent from the above description, when the cover is engaged with the connector body, the locking arm 18 closes the cut-out 12 formed in the side wall 11, serving as a part of the side wall 1. Hence, the locking arm 18 may be designed to be sufficiently large in thickness T. The locking groove 21, which engages with the metal piece 10 in such a manner that the locking arm covers the metal piece 10, has a side wall outside itself, and therefore the width D of the locking arm 18, as viewed in the longitudinal direction, can be decreased. On the other hand, it is preferable that the locking arm 18 have high mechanical strength to the extent that only one locking arm 18 is adequate to firmly engage the cover with the connector body. In this case, it is possible to greatly decrease the length A of the connector body 2.

As was described above, the cover 4 is fixedly locked to the connector body 2 by means of the metal piece 10 and the locking arm 18, so that the wires are firmly held by the wire retaining member 23 and the wire retaining grooves. Hence, even when the wires 5 are vertically pulled by an external force, the cover is never unlocked from the connector body, which markedly increases the reliability of the joint connector.

While the invention has been described with reference to its preferred embodiment, it should be noted that the invention is not limited thereto or thereby, and it will be obvious to those skilled in the art that various changes and modifications may be made therein without departing from the spirit of the invention. For instance, the joint connector may be modified as follows. In the above-described embodiment, the wires 5 are pushed into the slots 9A and 9B of the blades 8A and 8B before the cover 4 is engaged with the connector body 2. The joint connector may be so modified that, as the cover 4 is engaged with the connector body 2, the wires are automatically pushed into the slots 9A and 9B.

In addition, in the above-described embodiment, a metal piece is only formed at one end portion of the metal base 7 of the terminal 6. However, the joint connector may be so modified that a metal piece is formed as an individual component which is embedded in the connector body 2 in such a manner that its end portion appears in the side surface of the connector body 2.

Moreover, in the case of the terminal 6A shown in FIG. 5, it is preferable to provide a temporary locking metal piece above the metal piece 10 of the terminal 6A. The provision of the temporary locking metal allows the cover 4 to be temporarily locked to the connector body 2, thus accelerating the assembling work of the joint connector.

As was described above, in the press-connecting joint connector assembling method of the invention, the locking arm of the cover is locked to the metal piece which is provided in the connector body in such a manner that the metal piece appears in the side surface of the connector body, to cause the cover to hold the wires. Hence, the width of the metal piece, as viewed in the longitudinal direction, which is great in mechanical strength can be decreased, and in addition, the wires can be more positively held. That is, the joint connector of the invention is high in reliability.

Furthermore, in the method, the cover is engaged with the connector body after pressing the wires against the terminal. Hence, it is unnecessary for the cover body to have a mechanical strength which is great enough to press-connect the wires. This feature contributes to miniaturization of the joint connector.

With the press-connecting joint connector of the invention, the locking arm of the cover is engaged with the metal piece which is embedded in the connector body in such a manner that it appears in the side surface of the connector body. That is, the locking arm is locked to the metal piece high in mechanical strength. Hence, the width of the metal piece, as viewed in the longitudinal direction, can be decreased, and in addition, the wires can be more positively held. That is, the joint connector of the invention is high in reliability.

The plurality of press-connecting blades are extended from one and the same metal base. At least one of the two end portions of the metal base is exposed in the side surface of the connector body. Hence, it is unnecessary to embed a separate metal piece in the connector body. This feature contributes to simplification of the structure of the joint connector. Thus, the joint connector of the invention, when compared with the conventional one, is small in size, low in manufacturing cost, and high reliability.

When the locking arm is locked to the metal piece, it becomes a part of the side wall of the connector body. Additionally, the locking arm has the locking groove which allows the locking arm to be locked to the metal piece while covering the latter. Hence, the thickness of the locking arm can be made large enough; that is, the locking arm can be increased in mechanical strength. Hence, with only one locking arm, the cover is positively engaged with the connector body. Thus, the press-connecting joint connector of the invention, when compared with the conventional one, can be formed small in size and high in the reliability of mechanical strength.

What is claimed is:

1. A method of assembling a press-connecting joint connector, comprising the following steps:

providing a connector body with a terminal having a plurality of electrically interconnected press-connecting blades having recesses defined therein, and a cover for covering said connector body and holding a plurality of wires, said cover including a locking arm;

embedding a metal piece in said connector body such that a locking portion thereof extends to a side surface of said connector body;

placing a plurality of wires in said recesses of said press-connecting blades, respectively;

pressing said plurality of wires into said recesses, respectively, such that insulation of said wires is cut to thereby electrically interconnect said plurality of wires; and closing said cover and locking said locking arm to said locking portion.

2. A method as claimed in claim 1, wherein said pressing step occurs before said closing step.

3. A method as claimed in claim 1, wherein said pressing and closing steps occur simultaneously.

4. A press-connecting joint connector, comprising:

a connector body;

a terminal provided in said connector body and including a plurality of press-connecting blades which are electrically connected to one another to electrically connect a plurality of covered wires to one another when said wires are received in said press-connecting blades, respectively;

a cover which covers said connector body, said cover including a locking arm extending therefrom; and a metal piece embedded in said connector body in such a manner that an end portion of said metal piece is located in a side of said connector body, said end portion being engageable with said locking arm to secure said cover to said connector body.

5. A press-connecting joint connector as claimed in claim 4, wherein said terminal includes a metal base plate from which said plurality of press-connecting blades extend, said end portion being integral with said metal base plate.

6. A press-connecting joint connector as claimed in claim 4, wherein when said locking arm is locked to said metal piece, said locking arm becomes a part of a side wall of said connector body, and wherein said locking arm has a locking groove which is engaged with said metal piece in such a manner that said locking arm covers said metal piece.

7. A press-connecting joint connector as claimed in claim 4, wherein said plurality of press-connecting blades are offset from one another in a longitudinal direction of said plurality of wires.

8. The press-connecting joint connector as claimed in claim 4, wherein said plurality of press-connecting blades are located laterally adjacent one another.

9. The press-connecting joint connector as claimed in claim 4 wherein the width of said locking arm is substantially equal to said side of said connector body.

* * * * *